US012767420B2

(12) United States Patent
Guissart

(10) Patent No.: US 12,767,420 B2
(45) Date of Patent: Oct. 20, 2026

(54) DRUG DISPENSING DEVICE

(71) Applicant: INCARE, Prades-le-Lez (FR)

(72) Inventor: Jean-Baptiste Guissart, Prades-le-Lez (FR)

( * ) Notice: Subject to any disclaimer, the term of this patent is extended or adjusted under 35 U.S.C. 154(b) by 220 days.

(21) Appl. No.: 18/715,975

(22) PCT Filed: Dec. 2, 2022

(86) PCT No.: PCT/EP2022/084256

§ 371 (c)(1),
(2) Date: Jun. 3, 2024

(87) PCT Pub. No.: WO2023/099754

PCT Pub. Date: Jun. 8, 2023

(65) Prior Publication Data

US 2025/0033862 A1 Jan. 30, 2025

(30) Foreign Application Priority Data

Dec. 2, 2021 (FR) ..... 2112839
Dec. 24, 2021 (FR) ..... 2114500

(51) Int. Cl.
*B65D 83/04* (2006.01)

(52) U.S. Cl.
CPC ..... *B65D 83/0409* (2013.01); *B65D 2583/0404* (2013.01); *B65D 2583/0468* (2013.01); *B65D 2583/0477* (2013.01)

(58) Field of Classification Search
CPC ..... G07F 17/00; G07F 11/00; B65B 5/10; B65B 83/04; B65B 83/0409; B65B 2583/0404; B65B 2583/0468; B65B 2583/0477
USPC ..... 221/263
See application file for complete search history.

(56) References Cited

U.S. PATENT DOCUMENTS

2006/0079994 A1* 4/2006 Chu ..... G07F 11/62 700/231
2008/0319575 A1 12/2008 Vahlberg et al.
2012/0259458 A1* 10/2012 Barrett ..... G16H 20/10 221/258
2017/0015445 A1* 1/2017 Holmes ..... B65B 9/20

FOREIGN PATENT DOCUMENTS

WO 2016007319 A1 1/2016
WO 2018157231 A1 9/2018

OTHER PUBLICATIONS

Search Report; Mar. 15, 2023.

* cited by examiner

*Primary Examiner* — Leslie A Nicholson, III
(74) *Attorney, Agent, or Firm* — PatShegen IP; Moshe Pinchas

(57) ABSTRACT

The invention relates to a device for dispensing a plurality of drugs, the device comprising:

for each drug dose (25) of the plurality of drugs, a drawer (30) configured to accommodate a single dose of any of the drugs of the plurality of drugs;

a storage unit comprising cases (40), each case comprising at least one passage for holding drawers and, in each passage, drawers next to one another comprising all of the identical drug doses;

a unit (60) for preparing pillboxes (50) that is configured to pull drawers out from the cases of the storage unit and place the pulled-out drawers in a pillbox associated with a patient's identifier, the pillbox comprising a passage for holding the drawers that have been placed therein.

13 Claims, 10 Drawing Sheets

DRUG DISPENSING DEVICE

TECHNICAL FIELD OF THE INVENTION

The present invention relates to a drug dispensing device.

STATE OF THE ART

The automated systems for preparing pillboxes currently available on the market are installed in pharmacies. There are a number of reasons for this.

- They are quite large, and consequently not practical for installation in an infirmary or ward;
- They are very complicated, and therefore unsuitable for use by non-technical medical staff;
- Their complexity, slowness and inflexibility mean they are unable to manage "changes". As a result, they are mainly used in wards with few therapeutic changes during the patient's stay, and where the stay is more than five days.
- They are costly, therefore, to be cost-effective, the greatest possible pooling among care units, or even several health institutions, is necessary.

All these constraints, together with the requirements of the practices and regulations, do not make it possible to prepare pillboxes, even within care units. In addition, these automated systems utilise single-use packaging for receiving unit drug doses. This packaging is costly and harmful for the environment.

These automated systems do not allow drugs not dispensed, whatever the reason (e.g. prescription changed, patient discharged, or drug recalled by the laboratory that produced it), to be recycled automatically. Lastly, these automated systems do not allow the end-to-end traceability of the dispensing of drugs, from the drugs arriving at the health centre through to delivery to the patient, nor the identification of all the people involved in the dispensing process.

Document WO 2018/157231 describes a system for automatically filling drug organisers, which moves drug containers between a storage unit and temporary storage racks at the same time as the filling process. Document WO 2016/007319 describes a system comprising a drug transport appliance which accommodates a plurality of devices containing drugs. A controller in communication with the appliance generates a first association between a first device containing an accepted drug and a single patient and a second association between a second device containing an accepted drug and a specific type of medical item. Document US 2008/319575 describes a dispensing device in a health institution comprising containers for storing medical supplies, some of the containers being allocated for assignment to patients for storing their drugs and some other supplies.

PRESENTATION OF THE INVENTION

The present invention aims to remedy all or part of these drawbacks.

To this end, the present invention relates to a device for dispensing a plurality of drugs, according to claim 1.

Thanks to these provisions, there are no longer any consumables, each drawer returning to the storage unit after the drug dose it contained has been dispensed. In addition, a drug dose not dispensed is easily recycled by inserting the drawer containing it into the storage unit, in a passage where drawers including identical drug doses are located. In addition, end-to-end traceability is achieved for the dispensing process because the pillbox comprises the identification of the patient. The risks of error in the preparation, dispensing, administration or dosage are therefore reduced, or even eliminated. Moreover, except for the dispensing trolleys, the device can have the volume of a cabinet, much smaller than the volume of a dedicated room necessary for the preparation devices of the prior state of the art.

In some embodiments, at least one pillbox comprises, with regard to each drawer it comprises, an access hatch for access to the drug dose.

Consequently, the drawers do not need to be pulled out from the pillbox when the drug doses are dispensed to the identified patient. In addition, in the case where a drug dose has not been dispensed, for example because a prescription has been changed, the patient has been discharged, or the drug has been recalled, it is easy to keep it in the drawer that includes it by preventing the door corresponding to this drawer from being opened. The drug dose can therefore be easily re-used for another prescription, to the same or another patient.

In some embodiments, for at least one pillbox at least one hatch is configured to allow the drug dose to be released by gravity. Thanks to these provisions, no manual operation is required to remove the drug dose from of the pillbox.

In some embodiments, at least one hatch is equipped with a bolt preventing or allowing the opening of the hatch.

Thanks to these provisions, access to the drug dose is only possible after authorisation, which ensures traceability of the use of the drug, its presence in the drawer and, possibly, the operator that authorised access to this drug dose.

In some embodiments, the preparation unit comprises a first drawer-holder for inserting a drawer at one end of a passage of a case and a second drawer-holder for pulling out a drawer including a drug dose that has been pushed to the end of this passage, and inserting this removed drawer into one end of a pillbox, the first drawer-holder being configured to pull out a drawer of the pillbox pushed to the other end of the pillbox.

In this way, each passage of each case and each passage of the pillbox always comprises a constant number of drawers. In addition, a computer system can keep in memory, at all times, the location of each drug dose and each drawer.

In some embodiments, each case is equipped, at each end of the passage, with a bolt preventing or allowing the pulling out of the drawer closest to this end.

In some embodiments, each pillbox is equipped, at each end of the passage, with a bolt preventing or allowing the pulling out of the drawer closest to this end.

Thanks to each of these provisions, a drug dose cannot be put into a case and/or a pillbox or taken out of a case and/or pillbox until at least one bolt has been unlocked by the device.

In some embodiments, at least one bolt is magnetic. Thanks to these provisions, the bolts are passive, so that bringing a magnet near or controlling an electromagnet outside the case or pillbox is sufficient to control a bolt.

In some embodiments, the passage of a pillbox comprises as many drawers as each passage of a case. Handling of the drawers pulled out of the cases or pillboxes is thus made easier.

In some embodiments, the device that is the subject of the invention comprises at least one dispensing trolley comprising a plurality of holders of pillboxes, a means for displaying drug doses in a pillbox, means for unlocking a bolt for the hatches of a pillbox, and a means for receiving the content of each drawer for which a hatch has been opened.

In some embodiments, the device comprises a memory of prescriptions and recalls of drug doses, and means for verifying the compliance of the dispensing of each drug dose to a patient with a prescription associated to the patient and for verifying that the drug dose to be dispensed is not the subject of a recall, the verification means being configured to inhibit the unlocking of a hatch if at least one of the verifications gives a negative result. This therefore prevents a drug dose from being dispensed to a patient if it is not the time for taking this drug dose or if this drug dose has been recalled.

In some embodiments, each case and each pillbox bears a unique identifier, the device comprising a memory of the contents of each case and each pillbox. Thanks to these provisions, the device knows, at all times, where each drug dose is located.

In some embodiments, each drawer has an overall rectangular parallelepiped shape whose largest side has a dimension between 40 mm and 60 mm.

The inventors have determined that this shape and this dimension of the drawer mean that more than nine out of ten drug doses dispensed in health institutions in France can fit into the drawers of the device.

BRIEF DESCRIPTION OF THE FIGURES

Other advantages, aims and particular features of the invention will become apparent from the non-limiting description that follows of at least one particular embodiment of the device that is the subject of the present invention, with reference to drawings included in an appendix, wherein.

DESCRIPTION OF THE EMBODIMENTS

The present description is given in a non-limiting way, in which each characteristic of an embodiment can be combined with any other characteristic of any other embodiment in an advantageous way.

Throughout the description, the term "upper" or "top" refers to the normal configuration of use. The notions of vertical and horizontal flow from these definitions.

The device that is the subject of the invention concerns an automated solution for preparing and dispensing drug doses (for example, tablet, capsule or dry by mouth) in a health institution (or "HI"). This solution is modular, i.e. it is comprised of several mechanical and mechatronic elements that interact together. This modularity makes it possible to adapt to the specific requirements of each institution, for example a clinic, hospital or care home for dependent elderly people.

Figure 1:
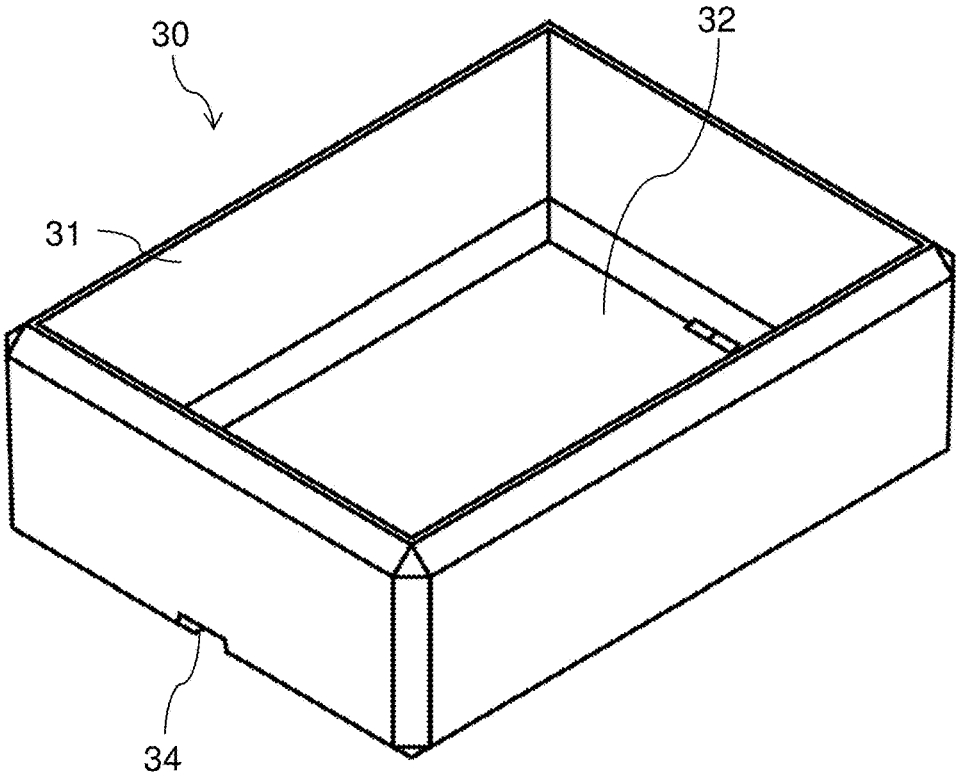
FIG. 1 represents, in perspective, an example of a drawer utilised in embodiments of the device that is the subject of the invention.
Figure 2:
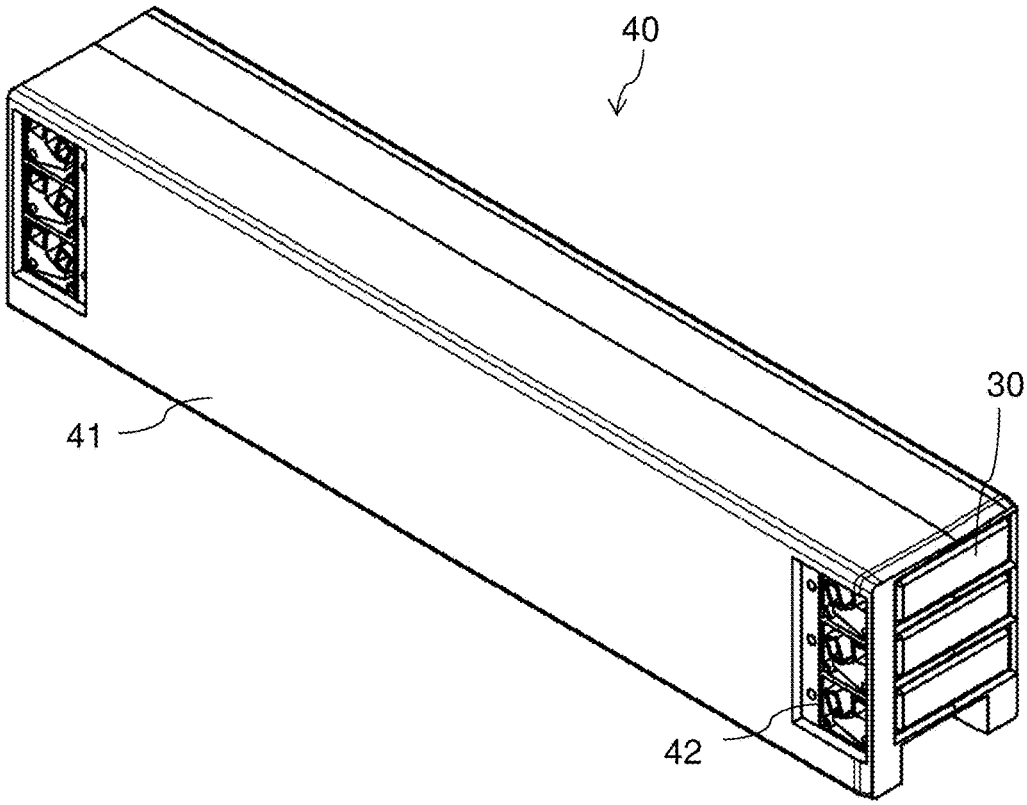
FIG. 2 represents, in perspective, a case comprising drawers, utilised in embodiments of the device that is the subject of the invention.
Figure 3:
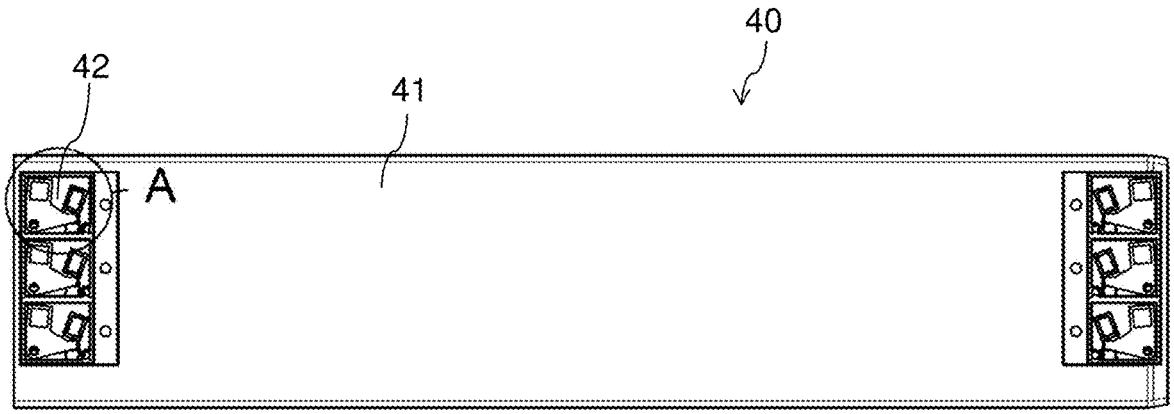
FIG. 3, represents, in a side view, the case illustrated in FIG. 2.
Figure 4:
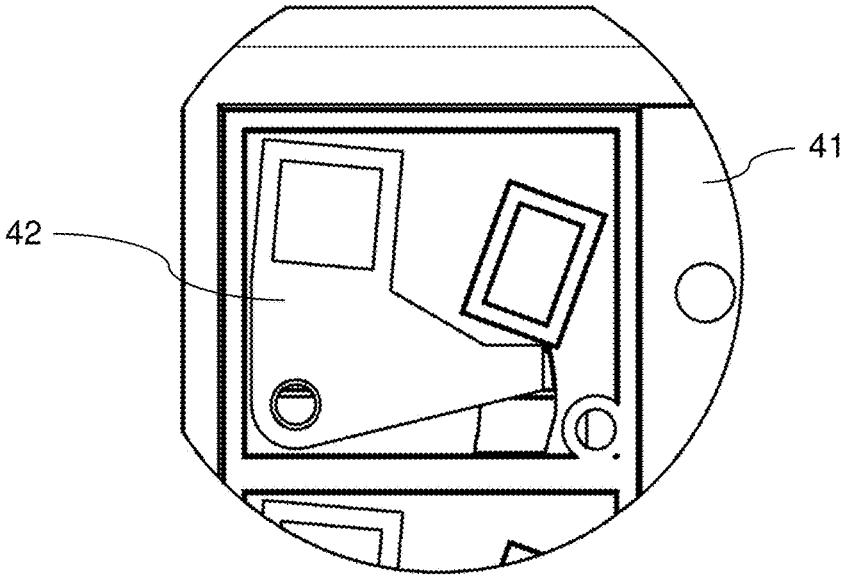
FIG. 4 represents, in an enlarged view, a portion of FIG. 3.

In general, the device for dispensing drug doses that is the subject of the invention comprises, for each drug dose, a drawer configured to accommodate a single dose of any of the drugs dispensed by this device. An example of a drawer is illustrated in FIG. 1.

Figure 16:
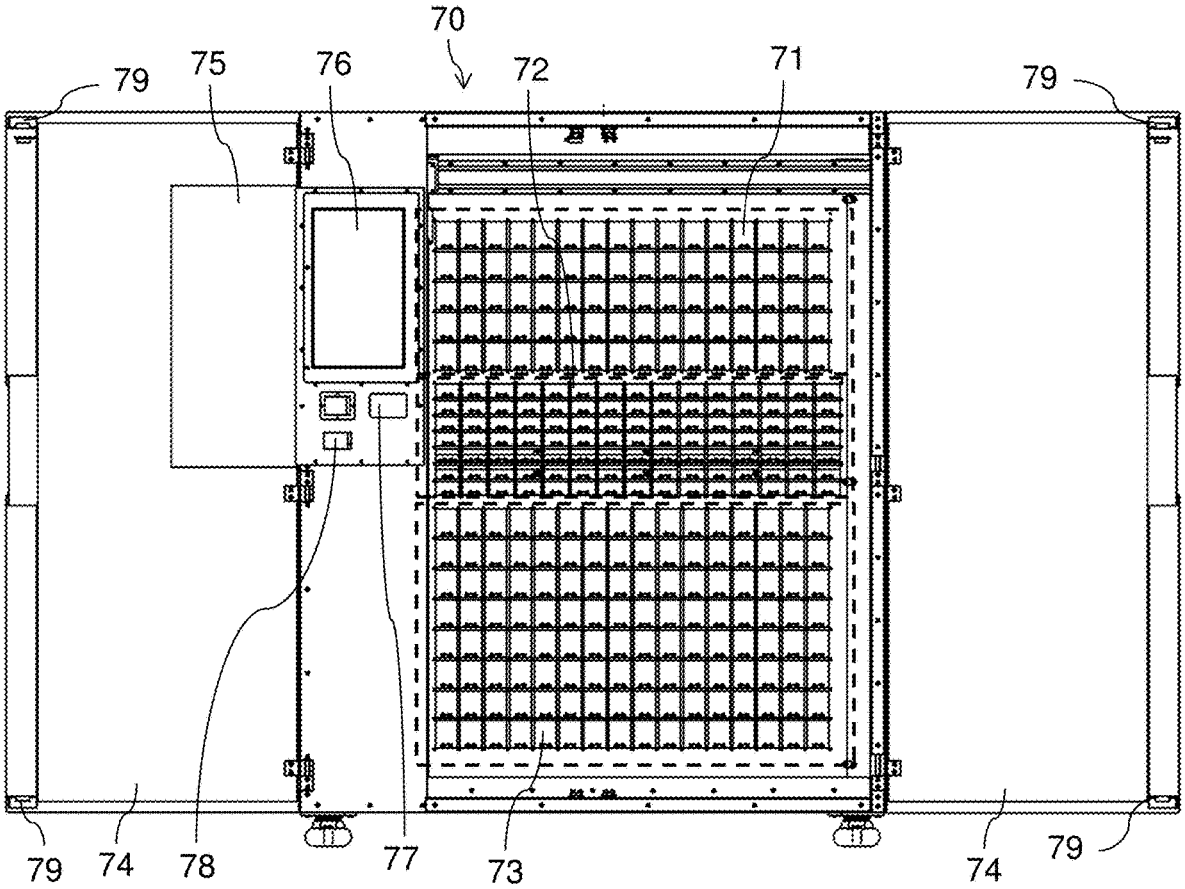
FIG. 16 is an overall front view of a preparation cabinet in an open configuration.

The device comprises a storage unit, or preparation cabinet, shown in FIG. 16, comprising cases shown in FIGS. 2 to 5. Each case comprises at least one passage for holding drawers and, in each passage, drawers next to one another, all comprising identical drug doses.

The device also comprises a unit, shown in FIGS. 11 to 15, for preparing pillboxes, themselves shown in FIGS. 6 to 10. This pillbox preparation unit is configured to pull drawers out from the cases of the storage unit and place the pulled-out drawers in a pillbox associated with a patient's identifier, the pillbox comprising a passage for holding the drawers that have been placed therein.

Figure 18:
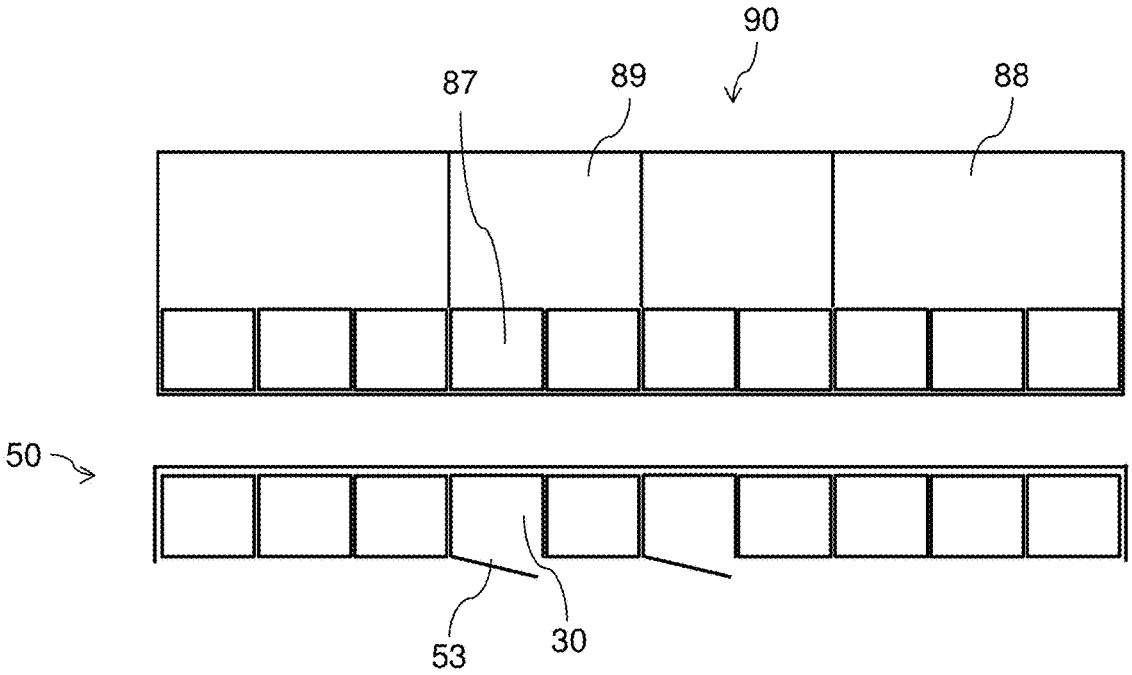
FIG. 18 represents, schematically, a drug dose dispensing system with hatches.
Figure 17:
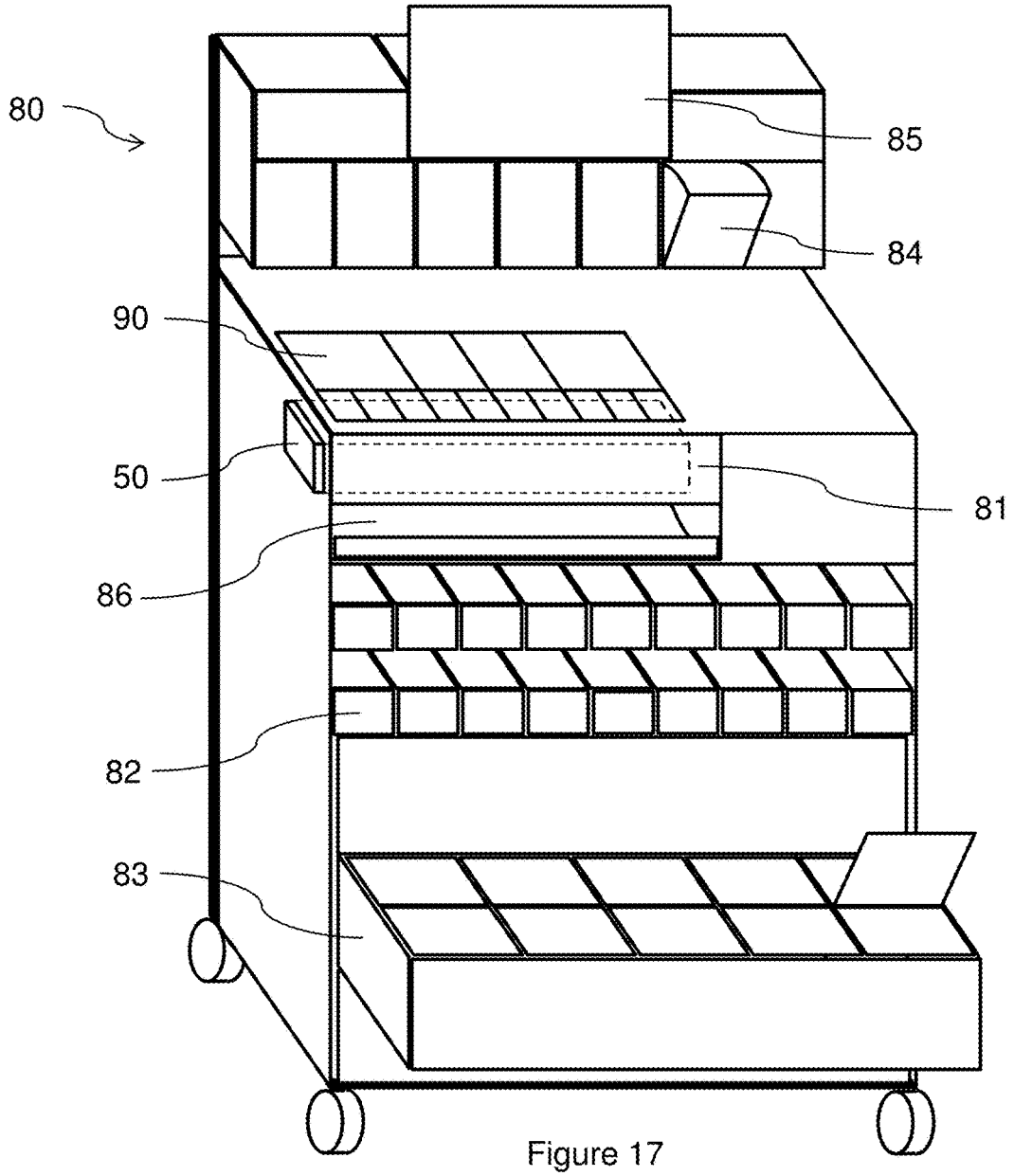
FIG. 17 represents, in perspective, a mobile dock for dispensing drug doses.

In the embodiment of the device that is the subject of the invention shown in the figures, this device comprises three docks, each in a separate location:

- a drug preparation dock, located in the pharmacy, (also called the filling dock), which inserts drawers, each of which includes a unit dose of an identical drug, into passages of the same case;
- a treatment preparation dock, which can be located in the infirmary or in a ward, (also called the preparation cabinet), which pulls drawers out from cases and inserts them into pillboxes; and
- a dispensing dock, usually placed in a mobile care trolley, shown in FIGS. 17 and 18, which makes it possible to help the nurse dispense drugs.

The drugs marketed by the pharmaceutical industry vary in shape and size. Their handling is therefore difficult to automate. To enable automation, the present invention standardises each drug dose by cutting up the drug packs and over-packaging them with a reusable overpack, called a "drawer", an example of which is shown, in perspective, in FIG. 1. This drawer 30 is the basic element of the various interactions between the three docks. It comprises a horizontal bottom 32, and four vertical sides 31. Preferably, the drawer 30 also comprises openings 34 in the sides, which allow the bolts 42 of cases 40 and/or bolts 52 of pillboxes 50 or 56 to block the drawer 30 that is located at one end of a passage.

Access to drug doses is preferably secured throughout the dispensing process. In effect, preferably, only the three docks mentioned above are able to unlock access to drug doses.

In some embodiments, each drawer 30 has an overall rectangular parallelepiped shape whose largest side has a dimension between 40 mm and 60 mm. The inventors have determined that this shape and this dimension of the drawers 30 mean that more than nine out of ten drug doses dispensed in health institutions in France can fit into the drawers 30.

Figure 5:
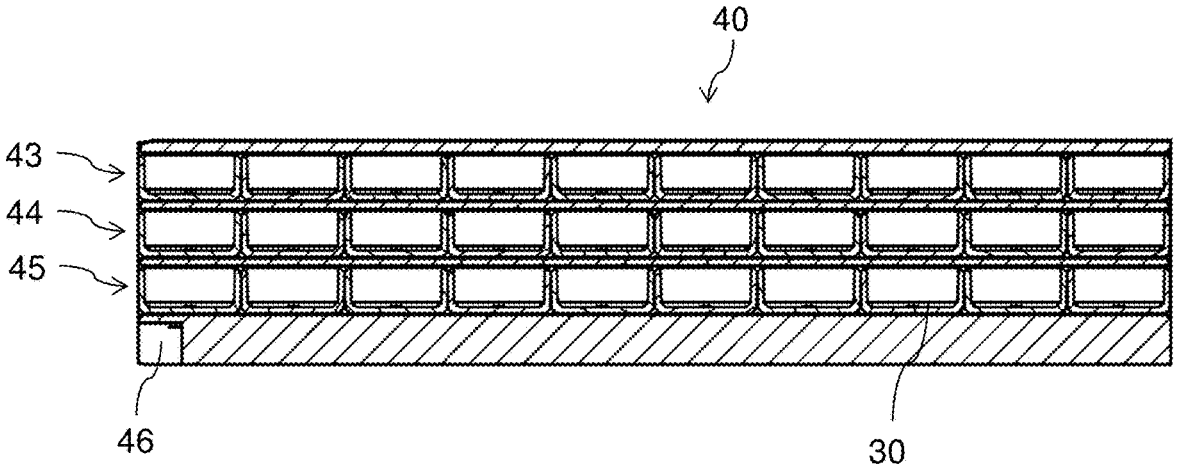
FIG. 5 represents, in a longitudinal and vertical cross-section view, a case illustrated in FIGS. 2 to 4.
Figure 6:
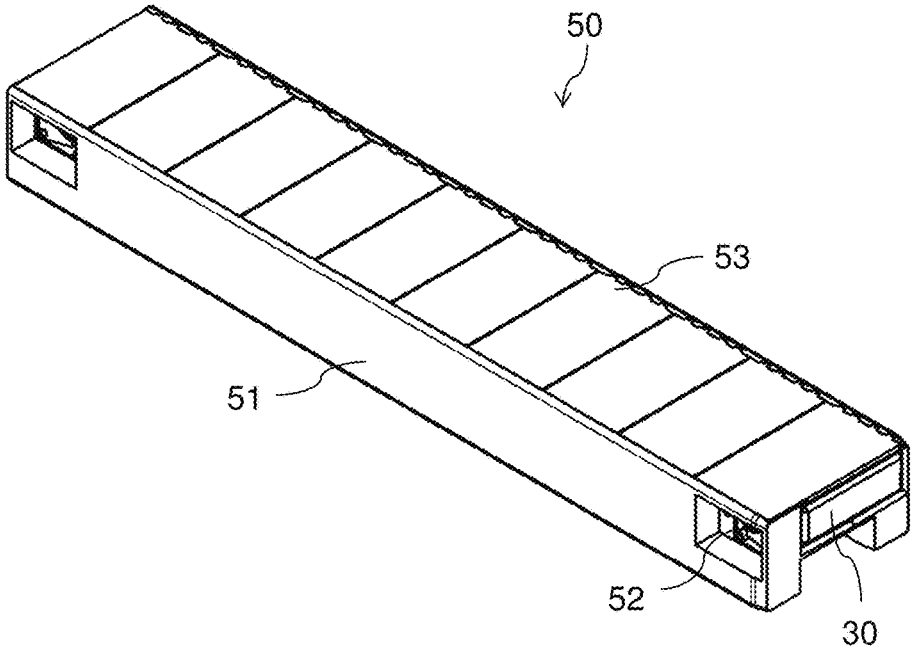
FIG. 6 represents, in perspective, a pillbox comprising drawers, utilised in embodiments of the device that is the subject of the invention.
Figure 7:
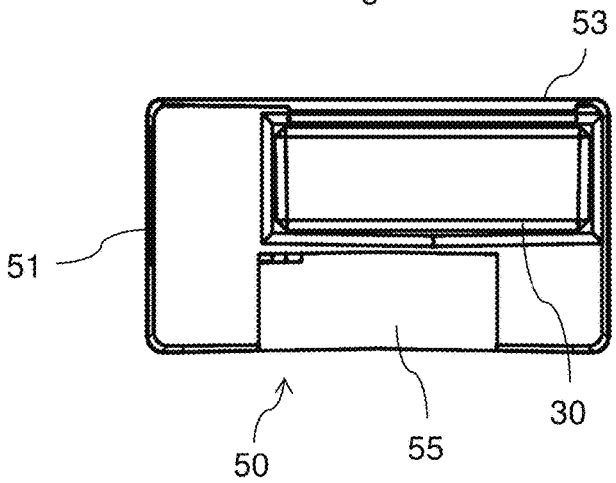
FIG. 7 represents, in a front view, the pillbox illustrated in FIG. 6.
Figure 8:
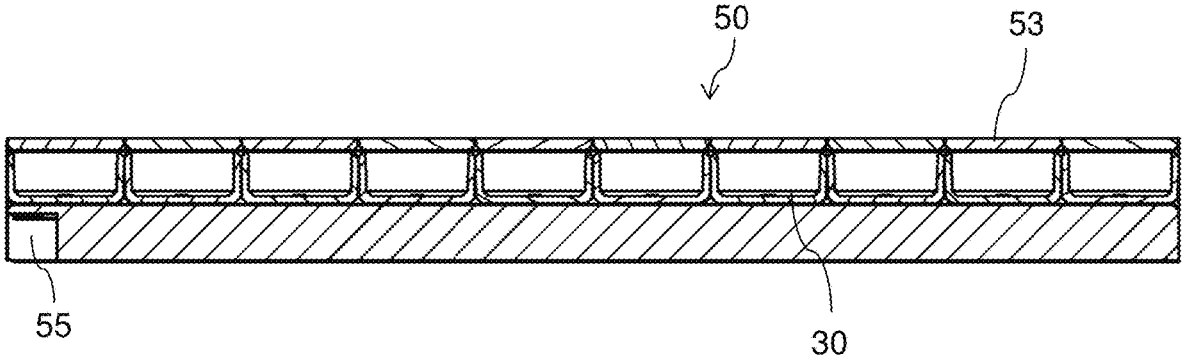
FIG. 8 represents, in a longitudinal and vertical cross-section view, a pillbox illustrated in FIGS. 6 and 7.
Figure 9:
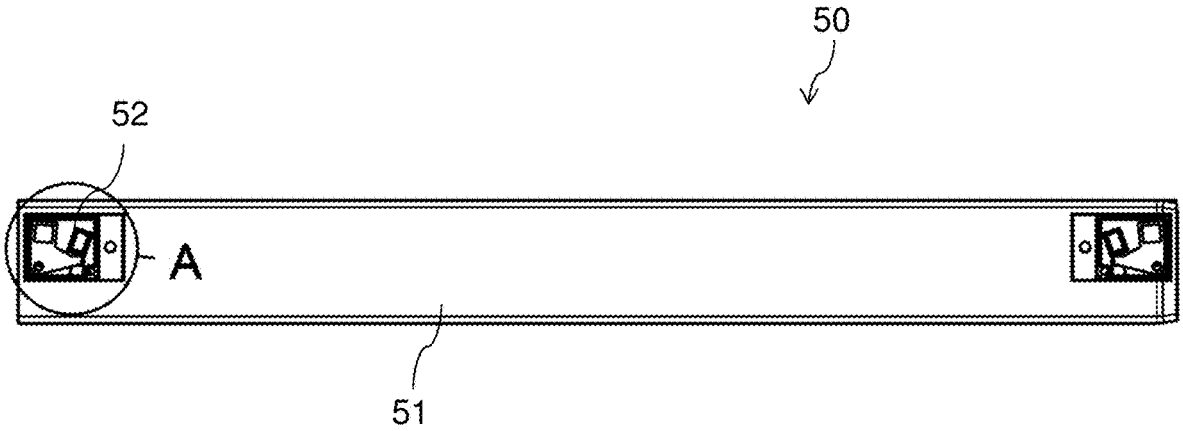
FIG. 9 represents, in a side view, the pillbox illustrated in FIGS. 6 to 8.
Figure 10:
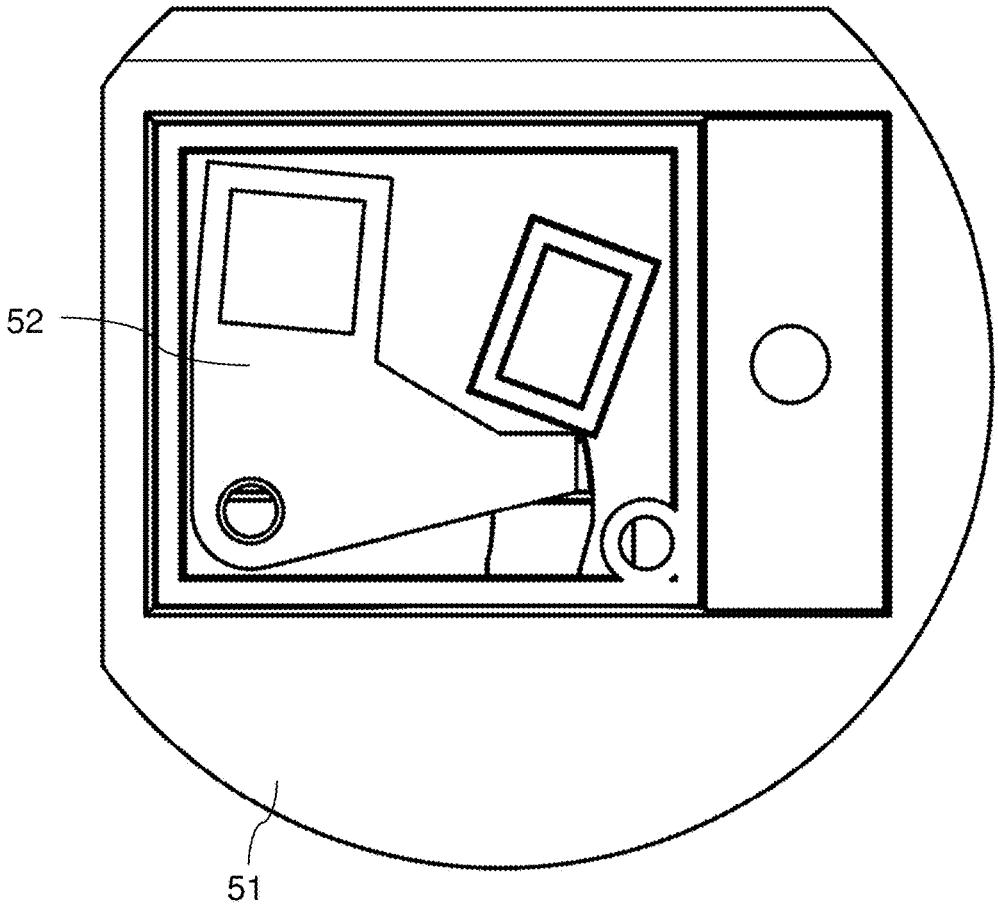
FIG. 10 represents, in an enlarged view, a portion of FIG. 9.

To facilitate the traceability of these doses in the process, the capacity of a drawer 30 is limited to one drug dose. The sizing of this drawer 30 is optimised based on a metrological study of the composition of the drug formulary of several institutions. Taking into consideration the volumes to be managed (e.g. 6000 doses a week for an institution with 60 patients), these doses, and therefore the drawers, are grouped into a "case" 40 comprising thirty drawers 30 in three superimposed passages. This has the advantage of facilitating the human operations in the logistical phases, and also the mechatronic operations in the treatment preparation dock 60. The case 40 also enables the technical simplification of the design of the drawer 30. In effect, the drawer 30 is closed to prevent manual access to the doses. The provision of a case 40 makes it technically possible to transfer the closure system from the drawer 30 to the case 40, which results in reducing the number of bolts required by a factor of five (six for the six ends of the passages instead of 30 for that number of drawers), which lessens the risk of failure. This system of bolts 42 prevents the drawers 30 from sliding out of the case 40, for example when the case 40 is inclined or handled. The case 40 interacts with the filling dock and the treatment preparation dock 60. A case 40 shown in FIGS. 2 to 5 contains thirty drawers 30, each of which includes an identical unit dose of the same drug. These drawers 30 are contained in three superimposed passages, 43 to 45, in a housing 41 equipped with a bolt 42 at each end of a passage, as shown in FIG. 5.

In an alternate to the uniformity of the drug doses contained in the drawers 30 of a case 40, for example for drugs dispensed less frequently, the drawers 30 of the same passage each contain an identical unit dose of the same drug but the drawers 30 of different passages of the same case 40 can each contain a different unit dose and/or a different drug.

The pillbox 50, shown in FIGS. 6 to 10, is the mobile final element of the dispensing process. The pillbox 50 accommodates a certain number of drugs intended for the same patient, within the framework of his prescription. For example, the capacity of the pillbox is ten drug doses in ten drawers 30 which follow one another in a single passage of the pillbox 50. This pillbox 50 interacts with the treatment preparation dock 60 and the dispensing dock 80. The dispensing dock 80, is either fixed, or mobile because it is equipped with castors. In the latter case, it is called a "mobile dispensing dock" or "dispensing trolley". Preferably, the passage of a pillbox 50 comprises as many drawers as each passage of a case 40.

Like the case 40, the pillbox 50 is equipped with a system of two bolts 52 (one at each end of the passage), preventing the drawers 30 held by a housing 51 from being pulled out.

The access hatches 53 enable the opening of the drawers 30, and therefore access to the unit drug doses contained therein, by the dispensing dock 80.

Preferably, for at least one pillbox 50 at least one hatch 53 is configured to allow the drug dose 23 to 28 to be released by gravity. In other embodiments, the opening of the hatch 53 gives the operator or an extraction mechanism access to the unit dose contained in the drawer 30.

Preferably, at least one hatch 53 is equipped with a bolt preventing or allowing the opening of the hatch 53. In other embodiments, no hatch 53 is equipped with such a bolt.

A slot 46 or 55 comprises a metal plate, enabling the case 40 and pillbox 50 to stick magnetically to magnets of the treatment preparation cabinet 70. This device makes it possible to ensure the proper alignment of the cases 40 and pillboxes 50 in the preparation cabinet 70 and prevents gripping by an operator with bare hands. To carry out the function of dispensing drugs at the level of the dispensing dock 80, it is provided with access hatches 53, also secured by bolts.

In some embodiments, at least one of the bolts described above is magnetic, so that bringing a predefined pole of a magnet near or switching on an electromagnet results in the unlocking of this bolt.

The filling dock (not shown) helps the operator in the phase of filling the cases 40. A possible separation of the drugs is carried out manually or in an automated way. The filling dock is an electromechanical element that:

limits the filling to a single type of drug per case 40;

enables the physical and digital traceability of each case 40 and its contents.

Software means guide the operator in the phase of identifying the drug, filling the drawers 30 and cases 40, and traceability.

Equipment means of the dock for filling cases comprise:

a) Mechanical elements in phase 1: unlocking the case 40 with pulling out all the drawers 30 of this case 40;

in phase 2: presenting drawers 30 to the operator for filling; and in phase 3: putting the drawers 30, each including a drug dose, back into the case 40 with locking of this case 40.

b) Electronic elements, which control the insertion and release of the case 40 by the mechanical elements and the positioning status of drawers 30 in the case 40.

The treatment preparation dock 60 is an automaton whose main function is the preparation of the pillboxes 50 of patients of the health institution.

The treatment preparation dock 60 in pillboxes 50 works in substantially the same way as a public beverage dispenser equipped with a Cartesian arm (two axes, X and Y) that collects the beverages.

The preparation cabinet 60 of the device that is the subject of the invention has, however, significant differences. This is because, in the beverage dispensers, there is one actuator per product to be distributed (Archimedes screw, belt conveyor). In contrast, in the treatment preparation cabinet 70, because there is a very large number of dispensing passages (in FIG. 16, with three passages per case 40, there are 624 passages of cases 40, as well as 105 pillboxes 50), one or two actuators are utilised.

Figure 11:
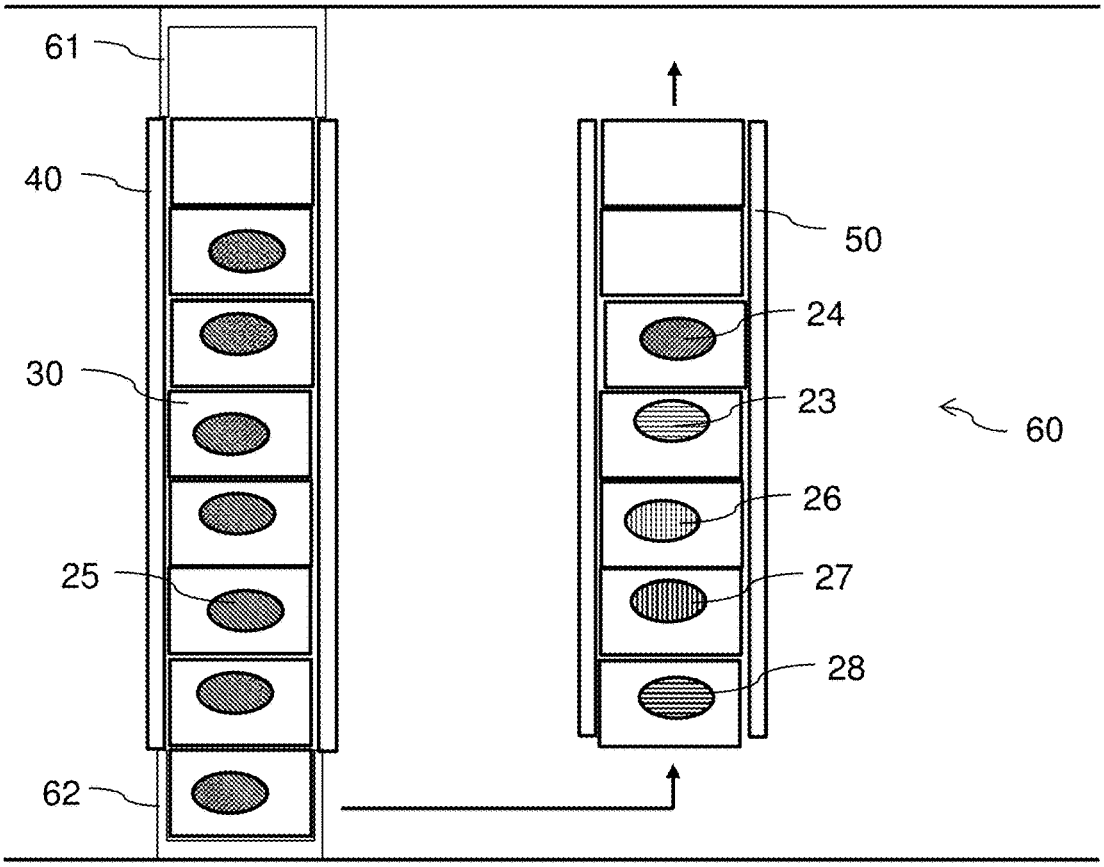
FIG. 11 represents, schematically and in a top view, a system for transferring drawers to a dock for preparing treatments from a cabinet for dispensing drug doses utilised in embodiments of the invention.
Figure 15:
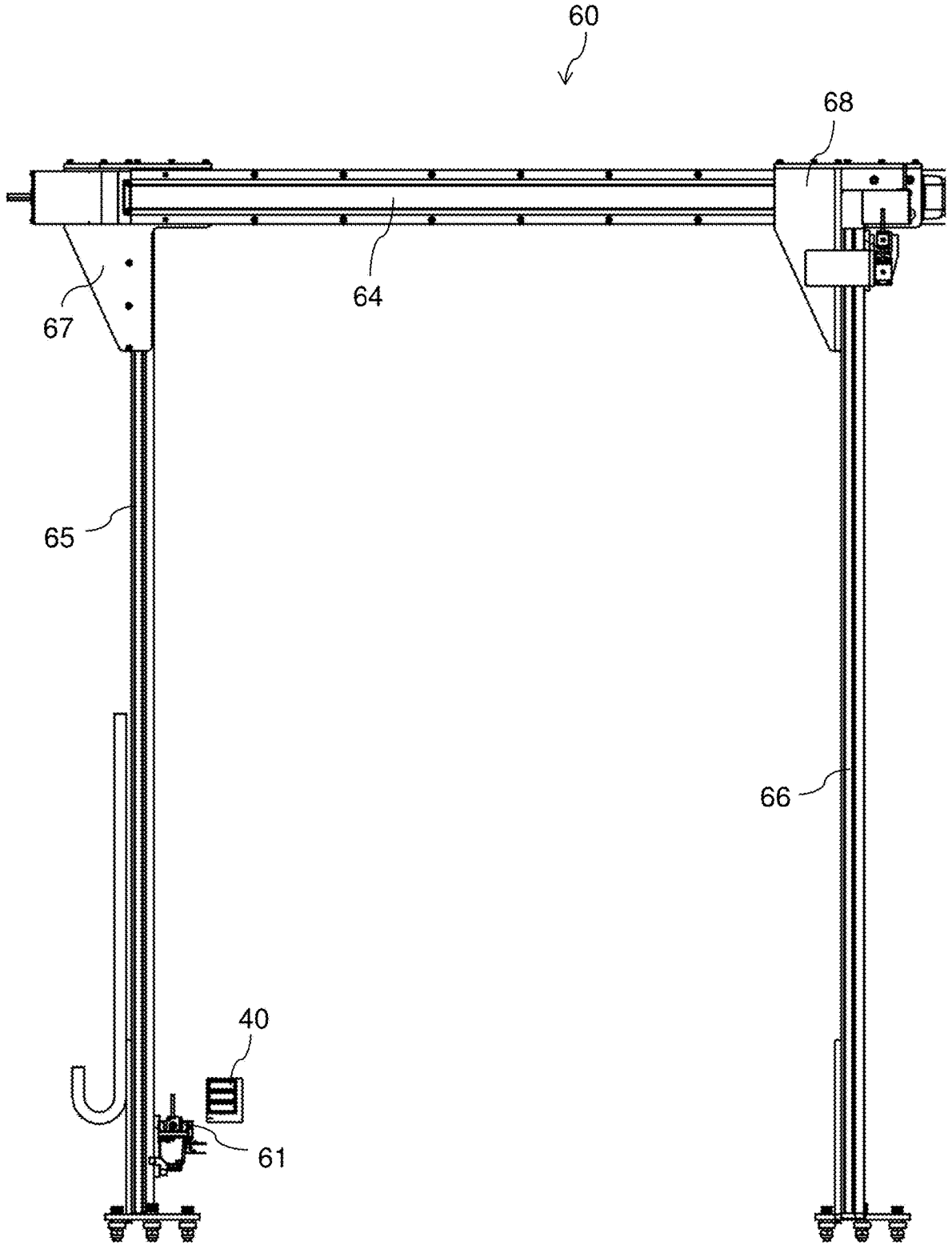
FIG. 15 represents, in a front view, the Cartesian gantry illustrated in FIGS. 13 and 14.

In some preferred embodiments, such as that shown in FIGS. 11 and 15, a second two-axis (XY) arm is provided at the rear of the automaton. The operation of this second arm mirrors that of the front of the automaton, and pushes the drawers including drug doses. In other words, the drawer-holders of the two arms are always facing the same passage of a case 40 or pillbox 50.

For the transfer of drawers 30 including the drug doses corresponding to the prescription for a patient, from the cases 40 to the pillboxes 50, and vice versa during the recycling of doses not dispensed, an endless loop principle is used. In this way, the empty drawers 30 are used as a stroke extension of an actuator piston associated to the drawer-holders 61 or 62 carried by the arms 65 and 66.

Therefore, the cases 40 and pillboxes 50 are always completely filled with empty or full drawers such that the stroke extension is constant.

Figure 12:
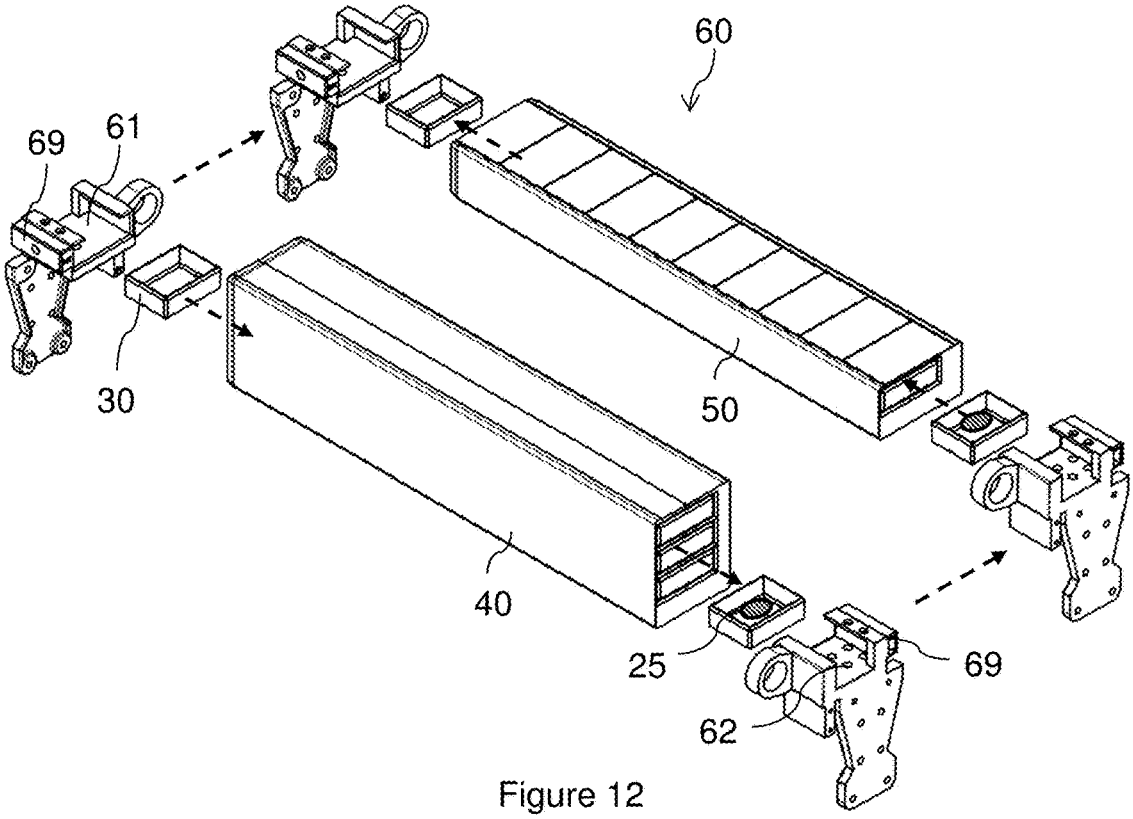
FIG. 12 represents, in perspective, a case, a pillbox and elements for pulling out drawers from this case and putting drawers into this pillbox.

The system for transferring drugs is shown schematically, with arrows illustrating the movements of the drawer-holders and drawers, in FIG. 11 and, more precisely, in FIG. 12. They show a rear Cartesian arm 65 with a drawer-holder 61 and a front Cartesian arm 66 with a drawer-holder 62. When the actuator of the drawer-holder 61 pushes a drawer 30 in the passage of a case 40, the drawer-holder 62 receives another drawer 30 that comprises a drug dose 25. Then the drawer-holder 62 is moved in front of the pillbox 50 associated with the identification of a patient to which this drug dose is intended. The actuator of the front drawer-holder 62 inserts this drawer 30 comprising the drug dose in the pillbox 50 while the rear arm 61, itself facing the same pillbox 50, receives a drawer 30, generally empty but which can contain a drug dose to be recycled, of the pillbox 50.

After it has been filled, the pillbox 50 includes different drug doses 23 to 28 (except where a prescription specifies taking several identical drug doses at the same time).

The bolts 42 or 52 comprise two magnets that repel each other (inserted into the two rectangles). In this way they allow the bottom portion of the bolt 42 or 52 to remain raised by default. This bottom portion fits into the slot 34 of the drawer.

Each drawer-holder 61 and 62 comprises a side magnet 69 mounted to repel the magnet of the bolt 42 or 52. Being positioned on either side of a passage of a case 40 or a pillbox 50, the two drawer-holders 61 and 62, mirrored, unlock the bolt 42 or 52, at each end of the passage, thus enabling the free movement of drawers in this passage of a case 40 or pillbox 50.

Figure 13:
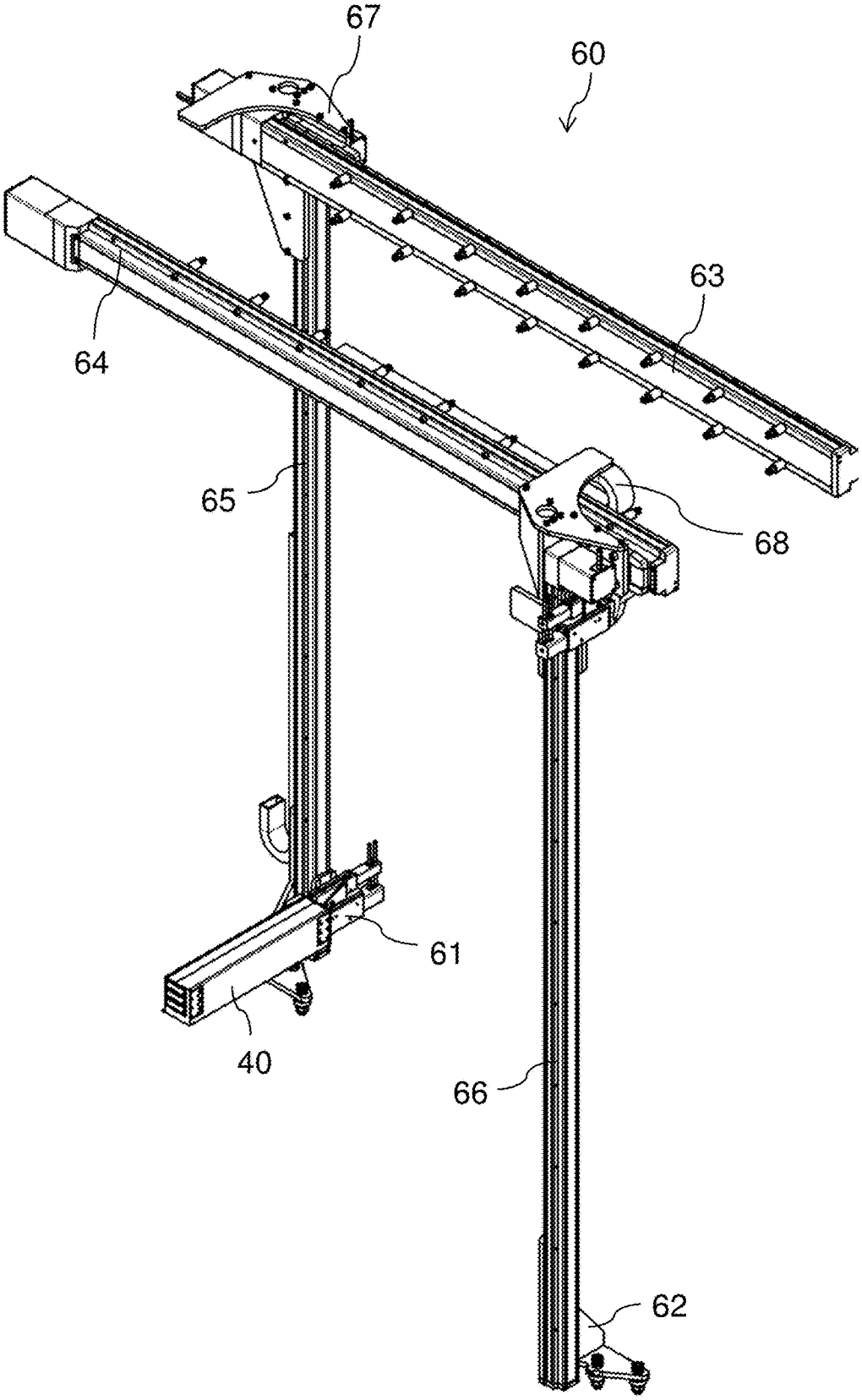
FIG. 13 represents, in perspective, a four-axis Cartesian gantry mirroring a dock for preparing treatments of a treatment preparation cabinet utilised in embodiments of the invention.
Figure 14:
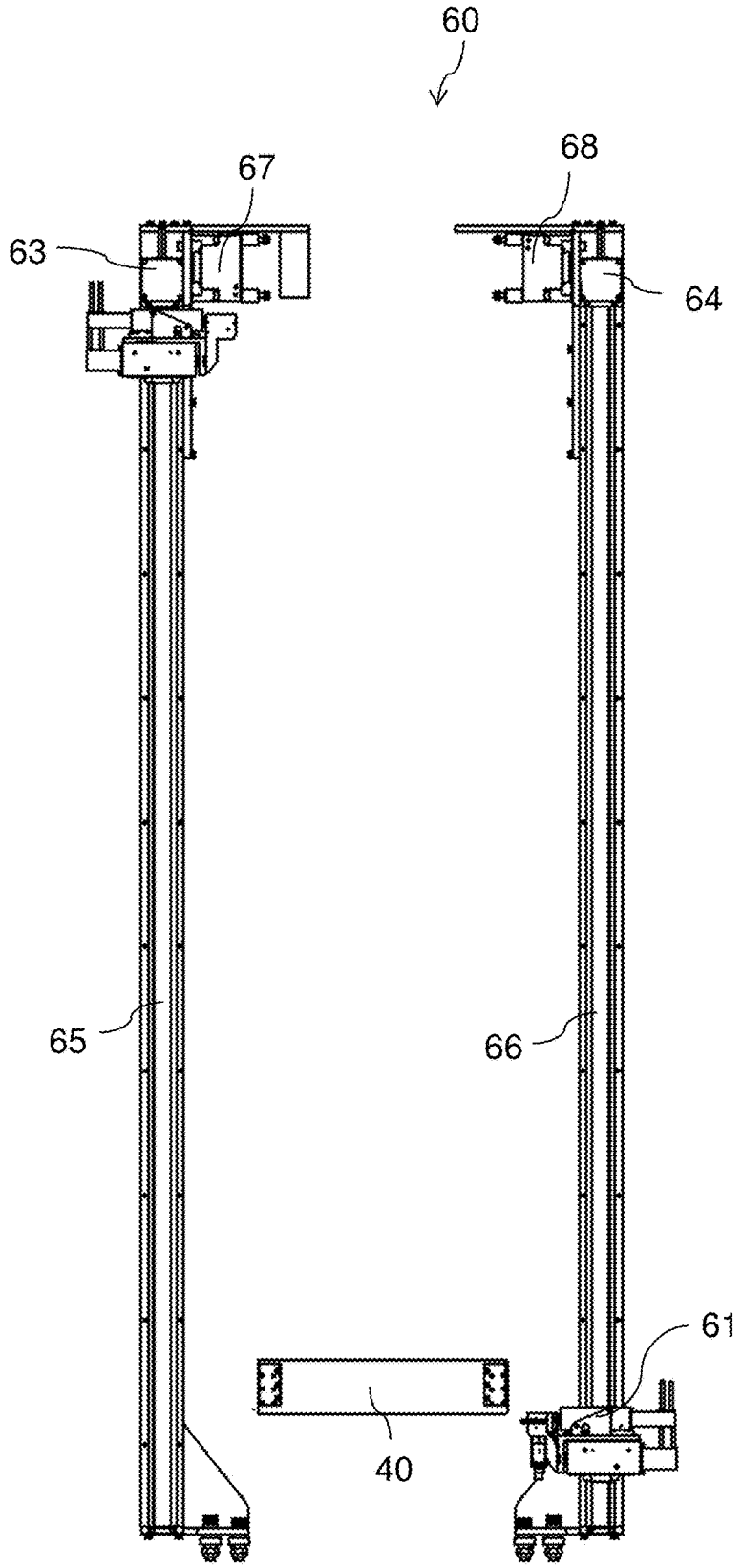
FIG. 14 represents, in a side view, the Cartesian gantry illustrated in FIG. 13.

FIG. 13 shows, in perspective, a four-axis Cartesian gantry mirroring a dispensing cabinet 60 utilised in embodiments of the invention. FIG. 14 shows, in side view, a four-axis Cartesian gantry mirroring a dispensing cabinet 60 utilised in embodiments of the invention. FIG. 15 shows, in front view, a four-axis Cartesian gantry mirroring a dispensing cabinet 60 utilised in embodiments of the invention. A tool-arm 65 or 66 of a Cartesian gantry bears a fixed drawer-holder 61 or 62 interacting directly with the drawers 30, the cases 40 and the pillboxes 50. The tool-arm is mounted on a motorised table. A piston makes it possible to interact with the drawer 30 carried by the drawer-holder.

A Cartesian gantry comprises two vertical arms 65 and 66 mounted on guide rails 63 and 64, and moving on these rails by means of motorised toothed wheels 67 and 68. The drawer-holders 61 and 62 move vertically, along tool-arms 65 and 66 respectively.

Each drawer-holder 61 or 62 is, preferably, equipped with a certain number of tools (not shown), for example:

- a key for unlocking cases 40 and pillboxes 50;
- an identification tool (electronic tag or barcode reader, etc.);
- sensors of the position and centring of the drawer-holder 61 or 62 during its approach to a passage of drawers 30 of a case 40 or pillbox 50.

FIG. 16 is an overall front view of the treatment preparation cabinet 70, comprising the treatment preparation dock 60 in a configuration with the doors 74 open. Preferably, the doors 74 are equipped with a lock 79, preferably magnetic, whose opening is controlled after identification of an operator, for example via a code or badge. In the cabinet 70 shown in FIG. 16, the left door 74 comprises a wide opening 75 giving access, even when the doors 74 are closed, to a control interface 76. With this interface 76, an identified operator can initiate an urgent preparation of a pillbox 50, the dock 60 then being ordered to give priority to preparing the pillbox thus ordered in urgency and position the drawers including the drugs of the treatment ordered in this pillbox 50. Once it is ready, this pillbox 50 is pushed by the treatment preparation dock to make it protrude through an opening 77 accessible via the opening 75. The operator can therefore take hold of the end of the pillbox 50 that protrudes, and pull this pillbox 50 out. In an alternate, a unit dose can be ordered by the identified operator, the treatment preparation dock therefore making a single drawer available to this operator by means of an opening 78 accessible via the opening 75.

The upper 71 and lower 73 areas contain cases 40. The central area 72 contains pillboxes 50.

In some embodiments, and preferably, the treatment preparation cabinet 70:

- has a suitable size for installation in an infirmary, e.g. 195 cm (H)×80 cm (P)×150 cm (W).
- can be used by a non-technical person who has neither the time nor the inclination to understand the reasons for any breakdown, let alone the time to contact a call centre ("hotline"); this device is reliable and robust.
- can be adapted to any type of ward, even with a high therapeutic change (cardiology, for example), and allows a pillbox to be produced urgently; this device is adaptable and can prepare a pillbox in less than five minutes.
- has a purchase price adapted to the maximum volume managed for the cabinet 70.

The cabinet 70 ensures a preparation capacity of about 100 pillboxes, an autonomy in drugs of at least one week, i.e. about 7000 doses, and a diversity of about 210 medical molecules.

With regard to the dispensing dock, drugs are dispensed, in the vast majority of cases, by means of a care trolley. In an alternate, a fixed dispensing dock is positioned in the health institution. FIG. 17 shows a mobile dock 80, or trolley, for dispensing drug doses. This trolley 80 contains patients' treatments, which are stored either in personalised pillboxes 50 or in non-personalised containers 84. In some preferred embodiments of the device that is the subject of the invention, this trolley 80 is enriched with additional elements:

- a module 81 for automatic dispensing;
- trays 82 for storing pillboxes 50;
- drawers 83 with automated personalised boxes, for the storage of other forms (syrup, cream, injectable, etc.) of medication, and other drugs referred to as "as-requireds"; and
- tilt bins 84 for the storage of drugs dispensed widely, i.e. with a very high turnover, such as Doliprane (registered trademark) and the "as-requireds".

The computer, electronic and electromechanical system of the dispensing dock 80 controls all the functions of the dock 80, i.e. the opening of the hatches 53 of pillboxes 50, the opening of boxes 83 and the opening of tilt bins 84. This is an electromechanical system controlled by a miniature personal computer, or tablet, 85, an electronic controller (not shown), and a touch screen 90 incorporated into the dispensing dock 80.

The dispensing module 81, shown here fixed in the dispensing dock 80, is preferably incorporated into a drawer of the dispensing dock 80, which makes it possible, when this drawer is pulled out, to reveal the touch screen 90 and the area in which to insert the pillbox 50.

With regard to the general operating principle of the dispensing dock 80 shown in FIG. 17, during drug dispensing, the nurse consults the patient's prescription on its computer 85. The nurse introduces the pillbox 50 bearing the patient's identification into the dispensing module 81 (by the left, in FIG. 17). The pillbox 50 is therefore recognised by an identification system (not shown) of the dispensing module 81. The recognition of the pillbox 50 and the patient's name may come from character, barcode or electronic tag reading, for example.

The dispensing module 81 then displays, on the touch screen 90, the treatments to be dispensed at the current time:

- the treatments contained in the pillbox 50;
- the treatments contained in the patient's box (non-pillbox area, in a drawer 83 with boxes);
- and the treatments contained in the tilt bins 84 (non-pillbox area).

The control of the hatches of the pillbox 50 involves, at the level of the dispensing module 81, a system of actuators, simple and not consuming much energy. Thus a gravitational dispensing system is utilised in which the pillbox 50 has one hatch 53 for each drawer 30. This hatch can only be actuated in the dispensing module 81, by means of an actuator (not shown), for example an electromagnet, as shown in FIG. 18.

A means 86 for receiving the contents of each drawer whose hatch 53 has been opened is located below the dispensing module 81. For example, the reception means 86 has a curved surface forming a chute on which the drug doses released by the hatches 53 slide.

The drugs supplied by the pharmaceutical industry are not always identifiable if they are separated into unit doses. In some embodiments, the dispensing dock 80 provides an additional function of physically identifying the drugs contained in each pillbox 50. Thus, the position of the touch screen 90 facing the pillbox 50 enables drugs contained in each drawer 30 to be identified. As shown in FIG. 18, preferably, the touch screen 90 is divided, in its bottom portion, into ten areas 87 which, when a pillbox 50 is inserted into the dispensing module 81, are located above each drawer 30 of the pillbox 50, which facilitates the identification of each drug that drops from the drawers 30. Therefore, during a dispensing operation, the drug released can be directly identified by the nurse.

Thanks to the connection of the dispensing module 81 to the health institution's in-house software system real-time knowledge of prescription changes), this module 81 can block certain drug doses in a pillbox 50, for different reasons such as an interruption in treatment or the withdrawal or recall of a batch of drug doses, for example, or when it is not the time to administer a drug dose to a patient. In the latter case, a visual, audible or digital alarm (e.g. on the screen of the computer 85) informs the nurse that she must come back at the time specified by the prescription, for dispensing the drug dose blocked in the pillbox 50.

To further improve the decision-making of the nurse, an area 88 is added on the touch screen 90 for assisting the administration (identification photo of the pill or capsule, of the pack, administration assistance notice, pictograph, ½ or ¾ pill, etc.).

Lastly, the dispensing dock 80 ensures the traceability of the dispensing of drug doses. This traceability has two aspects:

- the monitoring of medication observance (sending this information to the in-house software system); and
- the recycling of unused drug doses during the return of the pillbox 50 to the treatment preparation cabinet 70.

With regard to controlling the opening of personalised boxes 83, in the same way as for the pillboxes 50, when a drug is clicked on in the non-pillbox area 89, the hatch of the box 83, in which the product in question is stored, is unlocked, as shown in FIG. 17. The size of the packaging of products does not allow a position facing the touch screen 90 but these products, unlike pills and capsules, are always identified. A message in the "additional information" area 88 makes it possible to locate the box from which to obtain this product.

The operating principle of the tilt bins 84 is identical to that of the boxes 83, as shown in FIG. 17. These tilt bins 84 allow treatments not managed on an individual patient basis, such as treatments with a high turnover or "as-required" treatments (analgesic, laxative, etc.) to be made secure.

Figure 19:
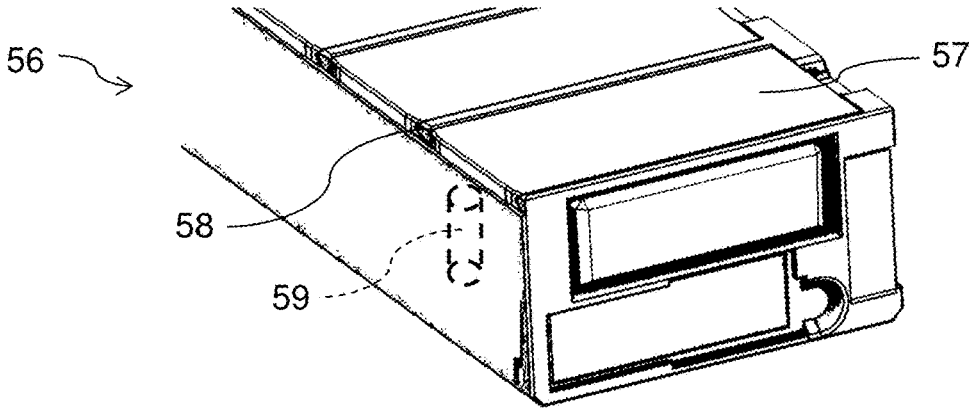
FIG. 19 represents, partially and in perspective, a variant of the pillbox.

In the variant shown in FIG. 19, the pillbox 56 comprises, instead of hatches 53 in rotation around hinges, hatches 57 in translation in rails 58, for example through the action of actuators (not shown).

The access hatches 57 enable the opening of the drawers 30, and therefore access to the unit drug doses contained therein, by the dispensing dock 80.

Preferably, for at least one pillbox 56 at least one hatch 57 is configured to allow the drug dose 23 to 28 to be released by gravity. In other embodiments, the opening of the hatch 57 gives the operator or an extraction mechanism access to the unit dose contained in the drawer 30.

Preferably, at least one hatch 57 is equipped with a bolt 59 preventing or allowing the opening of the hatch 53. For example, locking means 59, preferably magnetic, keep the hatches 56 closed until they receive unlock commands, for example by bringing a predefined pole of a magnet near or switching on an electromagnet.

In other embodiments, no hatch 57 is equipped with such a bolt.

As can be seen by reading the description above, the device for dispensing a plurality of drugs that is the subject of the invention comprises, for each drug dose of said plurality of drugs, a drawer configured to accommodate a single dose of any of the drugs of said plurality of drugs. This device also comprises a storage unit comprising cases, each case comprising at least one passage for holding drawers and, in each passage, drawers next to one another, all comprising identical drug doses. This device further comprises a unit for preparing pillboxes that is configured to pull drawers out from the cases of the storage unit and place the pulled-out drawers in a pillbox associated with a patient's identifier, the pillbox comprising a passage for holding the drawers that have been placed therein.

Preferably, the device that is the subject of the invention comprises a memory of prescriptions and recalls of drug doses, and software means for verifying the compliance of the dispensing of each drug dose to a patient with a prescription associated to the patient and for verifying that the drug dose to be dispensed is not the subject of a recall. This verification means is configured to inhibit the unlocking of a hatch 53 if at least one of the verifications gives a negative result for the drug dose contained in the drawer 30 associated to this hatch 53.

Each case 40 and each pillbox 50 preferably bears a unique identifier (character string, barcode or electronic tag, for example), the device comprising a memory of the contents of each drawer 30 of each case 40 and each pillbox 50. The software therefore knows, at all times, where each drug dose is located. In some embodiments, each case 40 and each pillbox 50 bears two unique identifiers, one that can be read by a camera and the other in the form of an electronic tag, for example utilising an RFID (acronym for Radio Frequency Identification) or NFC (acronym for Near Field Communication) protocol. Preferably, in this case, the treatment preparation cabinet 70 comprises a space in which a case 40 or pillbox 50 can be positioned so that its two identifiers are read at the same time and these identifiers are associated in the device's memory.

The invention claimed is:

1. A device for dispensing a plurality of drugs, comprising:

for each drug dose of said plurality of drugs, a drawer configured to accommodate a single dose of any of the drugs of said plurality of drugs;

a storage unit comprising cases, each case comprising at least one passage for holding drawers and, in each passage, drawers next to one another all comprising identical drug doses;

a unit for preparing pillboxes that is configured to pull drawers out from the cases of the storage unit and place the pulled-out drawers in a pillbox associated with a patient's identifier, the pillbox comprising a passage for holding the drawers that have been placed therein.

2. The device according to claim 1, wherein at least one pillbox comprises, with regard to each drawer it comprises, an access hatch for access to the drug dose.

3. The device according to claim 2, wherein for at least one pillbox at least one hatch is configured to allow the drug dose to be released by gravity.

4. The device according to claim 2, wherein at least one hatch is equipped with a bolt preventing or allowing the opening of the hatch.

5. The device according to claim 1, wherein the preparation unit comprises a first drawer-holder for inserting a drawer at one end of a passage of a case and a second drawer-holder for pulling out a drawer including a drug dose that has been pushed to the end of this passage, and inserting this removed drawer into one end of a pillbox, the first drawer-holder being configured to pull out a drawer of the pillbox pushed to the other end of the pillbox.

6. The device according to claim 1, wherein each case is equipped, at each end of the passage, with a bolt preventing or allowing the pulling out of the drawer closest to this end.

7. The device according to claim 1, wherein each pillbox is equipped, at each end of the passage, with a bolt preventing or allowing the pulling out of the drawer closest to this end.

8. The device according to claim 6, wherein at least one bolt is magnetic.

9. The device according to claim 1, wherein the passage of a pillbox comprises as many drawers as each passage of a case.

10. The device according to claim 4, which device comprises at least one dispensing dock comprising a plurality of holders of pillboxes, a means for displaying drug doses in a pillbox, means for unlocking bolts for the hatches of a pillbox, and a means for receiving the content of each drawer for which a hatch has been opened.

11. The device according to claim 10, which comprises a non-transitory computer-readable storage medium including prescriptions and recalls of drug doses, and means for verifying the compliance of the dispensing of each drug dose to a patient with a prescription associated to the patient and for verifying that the drug dose to be dispensed is not the subject of a recall, the verification means being configured to inhibit the unlocking of a hatch if at least one of the verifications gives a negative result.

12. The device according to claim 1, wherein each case and each pillbox bears at least one unique identifier, the device comprising non-transitory computer-readable storage medium including information regarding the contents of each case and each pillbox.

13. The device according to claim 1, wherein each drawer has an overall rectangular parallelepiped shape whose largest side has a dimension between 40 mm and 60 mm.

* * * * *